US008721203B2

(12) United States Patent
Ehrhardt, Jr.

(10) Patent No.: US 8,721,203 B2
(45) Date of Patent: May 13, 2014

(54) MEMORY SYSTEM AND METHOD FOR CONSUMABLES OF A PRINTER

(75) Inventor: Robert A. Ehrhardt, Jr., Palatine, IL (US)

(73) Assignee: ZIH Corp., Lincolnshire, IL (US)

( * ) Notice: Subject to any disclaimer, the term of this patent is extended or adjusted under 35 U.S.C. 154(b) by 843 days.

(21) Appl. No.: 11/244,620

(22) Filed: Oct. 6, 2005

(65) Prior Publication Data

US 2007/0081842 A1 Apr. 12, 2007

(51) Int. Cl.
*B41J 2/01* (2006.01)
*B41J 2/315* (2006.01)

(52) U.S. Cl.
USPC ..... 400/120.01; 347/20

(58) Field of Classification Search
USPC ..... 400/120.01
See application file for complete search history.

(56) References Cited

U.S. PATENT DOCUMENTS

| | | | |
|---|---|---|---|
| 4,496,237 | A | 1/1985 | Schron |
| 4,551,000 | A | 11/1985 | Kanemitsu |
| 4,585,327 | A | 4/1986 | Suzuki |
| 4,634,258 | A | 1/1987 | Tanaka |
| 4,751,484 | A | 6/1988 | Matsumoto |
| 4,851,875 | A | 7/1989 | Tanimoto |
| 4,855,754 | A | 8/1989 | Tanaka |
| 4,870,459 | A | 9/1989 | Ito et al. |
| 4,882,604 | A | 11/1989 | Kato |
| 4,930,915 | A | 6/1990 | Kikuchi |
| 4,961,088 | A | 10/1990 | Gilliland |
| 4,970,531 | A | 11/1990 | Shimizu |
| 4,974,020 | A | 11/1990 | Takamatsu |
| 4,994,853 | A | 2/1991 | Fukuchi |
| 5,049,898 | A | 9/1991 | Arthur |
| 5,049,904 | A | 9/1991 | Nakamura |
| 5,066,978 | A | 11/1991 | Watarai |
| 5,078,523 | A | 1/1992 | Gourty |
| 5,115,275 | A | 5/1992 | Suzuki |
| 5,132,729 | A | 7/1992 | Matsushita |

(Continued)

FOREIGN PATENT DOCUMENTS

| | | | |
|---|---|---|---|
| DE | 199 54 749 A1 | 5/2001 | |
| DE | 19954749 A1 * | 5/2001 | ..... B41J 2/175 |

(Continued)

OTHER PUBLICATIONS

Official translation of DE 19954749 A1, by FTS, Inc, dated Mar. 2009.*

(Continued)

*Primary Examiner* — Nguyen Ha
(74) *Attorney, Agent, or Firm* — Alston & Bird LLP

(57) ABSTRACT

A print head for use with a printer. The print head includes an input that receives data or commands associated with printing from the printer. A memory component of the print head is connected in communication with the input and is configured to bi-directionally communicate information to the printer via the input. For example, the memory component may be soldered to a circuit of a print head and connected to a data line normally used to communicate print data to the print head. In this manner, the print head may hold configuration information in the memory module for easy upgrades without an additional dedicated communication line. Also, printers may be upgraded, and print heads retrofit, with the memory component without installation of a dedicated input or communication line.

31 Claims, 9 Drawing Sheets

(56) References Cited

U.S. PATENT DOCUMENTS 5,137,379 A 8/1992 Ukai
5,148,534 A 9/1992 Comerford
5,206,685 A 4/1993 Hara
5,216,464 A 6/1993 Kotani
5,266,968 A 11/1993 Stephenson
5,272,503 A 12/1993 Lesueur
5,276,461 A 1/1994 Saito
5,283,597 A 2/1994 Yoshida
5,283,613 A 2/1994 Midgley
5,318,370 A 6/1994 Nehowig
5,319,426 A 6/1994 Baruch
5,333,960 A 8/1994 Nam
5,363,134 A 11/1994 Barbehenn
5,371,530 A * 12/1994 Hawkins et al. ..... 347/9
5,385,416 A 1/1995 Maekawa
5,410,641 A 4/1995 Wakabayashi
5,452,059 A 9/1995 Sekiya
5,455,617 A 10/1995 Stephenson
5,479,467 A 12/1995 Katsumata
5,489,971 A 2/1996 Nam
5,491,540 A * 2/1996 Hirst ..... 399/12
5,510,884 A 4/1996 Bov
5,512,988 A 4/1996 Donaldson
5,526,497 A * 6/1996 Zilka et al. ..... 710/316
5,546,163 A 8/1996 Asai
5,548,374 A 8/1996 Iguchi
5,572,292 A 11/1996 Chatani
5,579,088 A 11/1996 Ko
5,610,635 A 3/1997 Murray
5,627,572 A 5/1997 Harrington
5,636,032 A 6/1997 Springett
5,646,660 A 7/1997 Murray
5,666,585 A 9/1997 Nagira
5,699,091 A * 12/1997 Bullock et al. ..... 347/19
5,706,037 A 1/1998 Mcintyre
5,708,912 A 1/1998 Lee
5,714,995 A * 2/1998 Wiklof et al. ..... 347/208
5,717,974 A 2/1998 Park
RE35,751 E 3/1998 Midgley
5,755,519 A 5/1998 Klinefelter
5,760,795 A 6/1998 Beck
5,786,828 A 7/1998 Yamamoto
5,787,278 A 7/1998 Barton
5,788,388 A 8/1998 Cowger
5,794,095 A 8/1998 Thompson
5,797,060 A 8/1998 Thompson
5,797,061 A 8/1998 Overall
5,807,005 A 9/1998 Wright
5,812,156 A * 9/1998 Bullock et al. ..... 347/19
5,812,902 A 9/1998 Lee
5,823,690 A 10/1998 Narushima
5,831,649 A 11/1998 Wastrobski
5,835,817 A 11/1998 Bullock
5,835,818 A 11/1998 Hoshika
5,838,358 A 11/1998 Suzuki
5,847,814 A 12/1998 Antziopoulos
5,860,363 A 1/1999 Childers
5,877,692 A 3/1999 Watanabe
5,878,298 A 3/1999 Nakano
5,907,739 A 5/1999 Tsunemi
5,907,748 A 5/1999 Kawana
5,926,665 A 7/1999 Suzuki
5,926,666 A 7/1999 Miura
5,930,553 A 7/1999 Hirst
5,937,225 A 8/1999 Samuels
5,940,095 A 8/1999 Parish
5,950,038 A 9/1999 Okui
5,963,759 A 10/1999 Kojima
5,995,774 A 11/1999 Applegate
6,000,773 A 12/1999 Murray
6,011,937 A 1/2000 Chaussade
6,014,533 A 1/2000 Kawana
6,016,409 A 1/2000 Beard
6,019,449 A 2/2000 Bullock
6,019,461 A 2/2000 Yoshimura
6,022,094 A 2/2000 Gibson
6,028,674 A 2/2000 Tognazzini
6,039,430 A 3/2000 Helterline
6,065,824 A 5/2000 Bullock
6,068,372 A 5/2000 Rousseau
6,089,687 A 7/2000 Helterline
6,097,906 A 8/2000 Matsuzaki
6,099,101 A 8/2000 Maurelli
6,099,178 A 8/2000 Spurr
6,106,088 A 8/2000 Wafler
6,106,166 A 8/2000 Spurr
6,112,036 A 8/2000 Shinohara
6,113,208 A 9/2000 Benjamin
6,126,265 A 10/2000 Childers
6,144,812 A 11/2000 Ueno
6,151,041 A 11/2000 Bolash
6,158,837 A 12/2000 Hilton
6,158,850 A 12/2000 Cook
6,161,913 A 12/2000 Childers
6,161,916 A 12/2000 Gibson
6,163,658 A 12/2000 Suzuki
6,173,128 B1 1/2001 Saber
6,181,885 B1 1/2001 Best
6,188,852 B1 2/2001 Ojima
6,196,736 B1 3/2001 Otsuki
6,227,643 B1 5/2001 Purcell
6,233,409 B1 5/2001 Haines
6,243,120 B1 6/2001 Hevenor
6,263,170 B1 7/2001 Bortnem
6,264,301 B1 7/2001 Helterline
6,266,492 B1 7/2001 Maehara
6,267,463 B1 7/2001 Paulsen
6,271,928 B1 8/2001 Bullock
6,286,923 B1 9/2001 Sugahara
6,295,423 B1 9/2001 Haines
6,302,527 B1 10/2001 Walker
6,305,795 B2 10/2001 Childers
6,312,072 B1 11/2001 Hough
6,312,083 B1 11/2001 Moore
6,312,106 B1 11/2001 Walker
6,325,495 B1 12/2001 Foth
6,332,062 B1 12/2001 Phillips
6,339,684 B1 1/2002 Sato
6,343,193 B1 1/2002 Matsumoto
6,349,182 B2 2/2002 Otsubo
6,351,618 B1 2/2002 Pollocks
6,351,621 B1 2/2002 Richards
6,363,226 B1 3/2002 Batori
6,366,742 B1 4/2002 Reihl
6,375,301 B1 4/2002 Childers
6,381,418 B1 4/2002 Spurr
6,381,419 B1 4/2002 Kinoshita
6,385,407 B1 5/2002 Inose
6,386,772 B1 5/2002 Klinefelter
6,406,120 B2 6/2002 Pauschinger
6,408,141 B1 6/2002 Tahara
6,418,283 B1 7/2002 Wegman
6,427,054 B1 7/2002 Ohkubo
6,431,703 B2 8/2002 Rousseau
6,438,329 B1 8/2002 Budnik
6,454,381 B1 9/2002 Olsen
6,459,860 B1 10/2002 Childers
6,464,322 B2 10/2002 Dunand
6,467,864 B1 10/2002 Cornell
6,467,888 B2 10/2002 Wheeler
6,473,571 B1 10/2002 Wegman
6,476,928 B1 * 11/2002 Barbour et al. ..... 358/1.15
6,478,399 B1 11/2002 Mitsuzawa
6,488,352 B1 12/2002 Helterline
6,490,420 B2 12/2002 Pollocks
6,493,519 B2 12/2002 Sasame
6,498,905 B1 12/2002 Tsuruya
6,502,917 B1 1/2003 Shinada
6,505,013 B1 1/2003 Bedford
6,505,926 B1 1/2003 Trafton
6,511,142 B1 1/2003 Carmon
6,512,894 B2 1/2003 Takemoto
6,522,348 B1 2/2003 Brot
6,523,926 B1 2/2003 Mitsuzawa et al.

(56) References Cited

U.S. PATENT DOCUMENTS

| | | | | |
|---|---|---|---|---|
| 6,527,356 | B1 | 3/2003 | Spurr | |
| 6,532,351 | B2 | 3/2003 | Richards | |
| 6,535,697 | B2 | 3/2003 | Reihl | |
| 6,539,867 | B2 | 4/2003 | Lee | |
| 6,546,211 | B1 | 4/2003 | Shishikura | |
| 6,546,212 | B1 | 4/2003 | Ogata | |
| 6,550,902 | B2 | 4/2003 | Shinada | |
| 6,556,792 | B2 | 4/2003 | Yoshimura | |
| 6,559,973 | B2 | 5/2003 | Bullock | |
| 6,565,176 | B2 | 5/2003 | Anderson | |
| 6,565,198 | B2 | 5/2003 | Saruta | |
| 6,584,290 | B2 | 6/2003 | Kurz | |
| 6,584,291 | B1 | 6/2003 | Yamamoto | |
| 6,587,649 | B1 | 7/2003 | Yamamoto | |
| 6,588,872 | B2 | 7/2003 | Anderson | |
| 6,593,952 | B1 | 7/2003 | Funayama | |
| 6,597,875 | B2 | 7/2003 | Hasegawa | |
| 6,597,876 | B1 | 7/2003 | Sakurai | |
| 6,603,497 | B2 | 8/2003 | Hevenor | |
| 6,608,975 | B2 | 8/2003 | Sakurai | |
| 6,621,989 | B2 | 9/2003 | Otomo | |
| 6,625,402 | B2 | 9/2003 | Takemoto | |
| 6,629,134 | B2 | 9/2003 | Hayward | |
| 6,634,738 | B1 | 10/2003 | Shinada | |
| 6,636,702 | B2 | 10/2003 | Abe | |
| 6,644,544 | B1 | 11/2003 | Spurr | |
| 6,644,771 | B1 | 11/2003 | Silverbrook | |
| 6,683,638 | B2 | 1/2004 | Sato | |
| 6,687,634 | B2 | 2/2004 | Borg | |
| 6,694,107 | B2 | 2/2004 | Sakurai | |
| 6,708,005 | B2 | 3/2004 | Chihara | |
| 6,714,745 | B2 | 3/2004 | Sasame | |
| 6,722,753 | B2 | 4/2004 | Helterline | |
| 6,735,399 | B2 | 5/2004 | Tabb | |
| 6,738,903 | B1 | 5/2004 | Haines | |
| 6,748,182 | B2 | 6/2004 | Yoshida | |
| 6,755,580 | B2 * | 6/2004 | Furukawa et al. | 400/120.01 |
| 6,791,704 | B1 | 9/2004 | Moreau | |
| 6,793,307 | B2 | 9/2004 | Spurr | |
| 6,798,997 | B1 | 9/2004 | Hayward | |
| 6,799,001 | B2 | 9/2004 | Takeuchi | |
| 6,802,659 | B2 | 10/2004 | Cremon | |
| 6,807,380 | B2 | 10/2004 | Iida | |
| 6,807,382 | B1 | 10/2004 | Sakurai | |
| 6,820,039 | B2 | 11/2004 | Johnson | |
| 6,823,416 | B1 * | 11/2004 | Dempsey et al. | 710/305 |
| 6,853,814 | B2 | 2/2005 | Ito | |
| 6,871,027 | B2 | 3/2005 | Ito | |
| 6,879,785 | B2 | 4/2005 | Ito | |
| 6,879,786 | B2 | 4/2005 | Ito | |
| 6,894,711 | B2 | 5/2005 | Yamakawa | |
| 6,903,837 | B1 | 6/2005 | Moreau | |
| 6,904,242 | B2 | 6/2005 | Ito | |
| 6,963,351 | B2 | 11/2005 | Squires | |
| 2002/0060708 | A1 | 5/2002 | Elliott | |
| 2002/0063760 | A1 | 5/2002 | Dietl | |
| 2002/0140751 | A1 | 10/2002 | Imanaka et al. | |
| 2004/0141019 | A1 * | 7/2004 | Schloeman et al. | 347/11 |
| 2005/0116975 | A1 * | 6/2005 | Kasai | 347/10 |
| 2006/0002753 | A1 * | 1/2006 | Hunsberger, Jr. | 400/703 |
| 2006/0098078 | A1 * | 5/2006 | Lee | 347/171 |

FOREIGN PATENT DOCUMENTS

| | | | |
|---|---|---|---|
| EP | 0 766 195 | A2 | 4/1997 |
| EP | 0766195 | A2 | 4/1997 |
| EP | 0 802 059 | A2 | 10/1997 |
| EP | 0802059 | A2 | 10/1997 |
| EP | 1 182 039 | A1 | 2/2002 |
| EP | 1182039 | A1 | 2/2002 |
| EP | 1 300 250 | A2 | 4/2003 |
| EP | 1300250 | A2 | 4/2003 |
| JP | 10-278360 | A | 10/1998 |
| WO | WO 03/021390 | A2 | 3/2003 |
| WO | WO-03/021390 | A2 | 3/2003 |

OTHER PUBLICATIONS

International Search Report for PCT/US2006/039013, completed on Feb. 25, 2007, mailed on Feb. 27, 2007.

Extended European Search Report from European Patent Application No. 10011174.9, dated Dec. 2, 2010.

Japanese Office Action for Application No. 200680045908.8, dated Mar. 4, 2013.

* cited by examiner

MEMORY SYSTEM AND METHOD FOR CONSUMABLES OF A PRINTER

BACKGROUND OF THE INVENTION

1. Field of the Invention

The present invention is directed to print heads for use with media printers capable of printing indicia on printable media, and more particularly to a removable print head that includes a memory component capable of storing and/or receiving information.

2. Description of the Related Art

The majority of commonly available printing and copying devices, including media printers capable of printing indicia (such as text, graphics, and the like) on printable media, include an electronic controlling device that, in addition to processing the print data to create the desired indicia, also controls various print parameters of the printing device. For example, commonly available media printers capable of printing indicia on printable media include ink jet and thermal printers that are capable of printing indicia on printable media such as paper, labels, substrates and the like, including lined and linerless media. Print heads for use with these printers are typically removable and replaceable, and thus a single printer may receive several print heads over its lifetime. Additionally, flexibility in media handling provided by commonly available printing and copying devices means that a single printer may be used with a variety of different types of printable media, such as those described above.

In general, thermal printers print indicia on printable media using either direct thermal printing, thermal transfer printing, or both, depending on the type of printable media used in the printer. A thermal print head includes a multitude of printing elements generally disposed in an array across the length of the print head body, perpendicular to the path of the media. The element array may be thermally activated in groups, or each element may be thermally activated individually. Direct thermal printing typically requires media that has a temperature-sensitive surface coating. The printable media is biased against the print head by a backing roller, sometimes referred to as a platen roller. In the case of direct thermal printing, indicia is created on the printable media by heating up an area of the printable media directly beneath the activated elements. The temperature-sensitive coating of the media reacts to the increase in temperature and the indicia is created on the printable media.

A similar print head configuration is generally used with regard to thermal transfer printing, however the printable media used in conjunction with a thermal transfer printer does not typically include a temperature-sensitive surface coating. Instead, thermal transfer printing includes a ribbon containing dye thereon. In such a case, the ribbon is placed between the thermal print head and the printable media. Indicia is created on the printable media by heating up an area of the transfer ribbon beneath the activated elements of the print head. The heat from the print head transfers dye from the ribbon to the printable media.

As noted above, although a single thermal print head may be used for direct thermal printing or for thermal transfer printing, operating parameters relating to the two methods of printing may be different, and such differences may be advantageous in order to provide a user with optimal print performance. For example, the operating temperature of the print head elements, the pressure between the print head and the platen roller, and the feeding rate of the media may be different in order to provide optimal results for the two different methods of thermal printing. Thus, a particular temperature-sensitive ribbon may require a different operating print head temperature than media with a temperature-sensitive coating, and different brands of temperature-sensitive coated media may operate optimally at different print head temperatures.

Moreover, print head information, such as information about the print head itself, or printer information, such as information about the printer, may be advantageous in order to provide a user with optimal print performance. As such, for example, print heads produced by different manufacturers or print heads produced during different production runs may have different performance characteristics. Thus, print head information that identifies the print head, such as various manufacture and identification information, may be useful in order to control printing parameters to optimize print performance when using various print heads. Furthermore, specialized applications often require specialized printing parameters. For example, a printer used in a food processing application, that prints labels from a weigh-scale, is exposed to an exceptionally corrosive environment and may benefit from a printhead incorporating specialized protective coatings that, in turn, require printing parameters different from those of the standard model printhead.

Print heads currently exist that include memory modules for storing various usage and calibration data. For example, U.S. Pat. No. 6,523,926 to Mitsuzawa describes the use of head identification information that is characteristic of the print head so that positional deviation can be avoided during printing. A driver integrated circuit of the print head unit includes a non-volatile memory such as a programmable ROM, for storing the print head identification information. However, many of these prior art print heads include memory modules that utilize read-only memory, do not provide secure memory, and/or require additional communication connections through which the usage and calibration data is transmitted.

Thus, there is a need for an efficient and inexpensive apparatus, system and method for communicating printer and print head information between a printer and a print head. The apparatus, system and method should provide flexibility for the printer and the print head, should provide non-secure and secure memory, and should be capable of storing and receiving a variety of information.

BRIEF SUMMARY OF THE INVENTION

The present invention addresses the above needs and achieves other advantages by providing a print head for use with a printer. The print head includes an input that receives data or commands associated with printing from the printer. A memory component of the print head is connected in communication with the input and is configured to bi-directionally communicate information to the printer via the input. For example, the memory component may be soldered to a circuit of a print head and connected to a data line normally used to communicate print data to the print head. In this manner, the print head may hold configuration information in the memory module for easy upgrades without an additional dedicated communication line. Also, printers may be upgraded, and print heads retrofit, with the memory component without installation of a dedicated input or communication line. The memory component may contain print head information or printer information for improving the function of the print head or printer.

In one embodiment, the present invention includes a print head for use with a printer. The print head includes at least one input for receiving data or commands associated with printing from a printer. The print head may also include a memory component in communication with the input. The memory component is configured to allow communication of information bi-directionally between the memory component and the printer via the input.

The input may receive the data or commands associated with printing while the printer is printing, and then use the input for bi-directional communication of information when not printing. For example, configuration information for the print head may be communicated upon start up and initialization of the printer, but not during printing.

In another aspect, a print head having a previously dedicated (unidirectional) input for printing data may be converted by attachment of the memory component to the input. Similarly, previously unidirectional connections to the printer, such as a connection of the printer to the input of the print head, may be converted or used for bi-directional communication from the memory component.

In another aspect, the memory component may include secure and non-secure portions. The secure portion may contain information facilitating improved operation of the print head or printer, but require a data key for security against viruses and incorrect written printer or print head information.

The print head may include its own dedicated circuit that is physically associated with the print head, e.g., such as by being supported by or connected to the print head. In turn, the memory component may be physically associated with the circuit, such as by being wired or soldered to the circuit. This facilitates connection of, or replacement with, a single unit print head.

The present invention has many advantages, including providing an additional option for the storage of upgrade information on a single consumable component (i.e., the print head) that automatically and securely upgrades printer operation upon replacement. This eliminates or reduces the need for dedicated firmware upgrade procedures. In addition, since communication is performed over existing or previously dedicated inputs and communication lines, the memory component may be used on existing print head configurations and without adding additional communication lines or inputs to the printer or print head.

BRIEF DESCRIPTION OF THE SEVERAL VIEWS OF THE DRAWINGS

The objects and advantages of the present invention will become more readily apparent to those of ordinary skill in the relevant art after reviewing the following detailed description and accompanying drawings, wherein.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Figure 1:
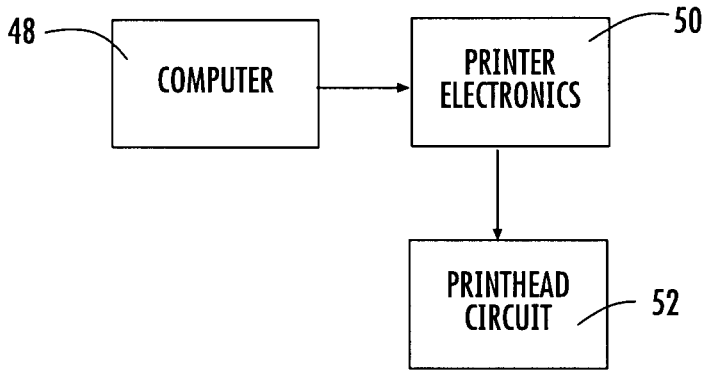
FIG. 1 (PRIOR ART)
FIG. 1 is a block diagram showing prior art communications between a computer, printer electronics, and a print head circuit.

In a conventional printer, shown by block diagram in FIG. 1, printing commands, as well as other processing data, generally originate from a computer, terminal or other originating device, and are then communicated to the remaining printer components through printer electronics 50. The printer electronics 50 process the printing commands and other processing data into print data that is communicated by the printer electronics 50 to a circuit 52 of a print head 20.

Figure 2:
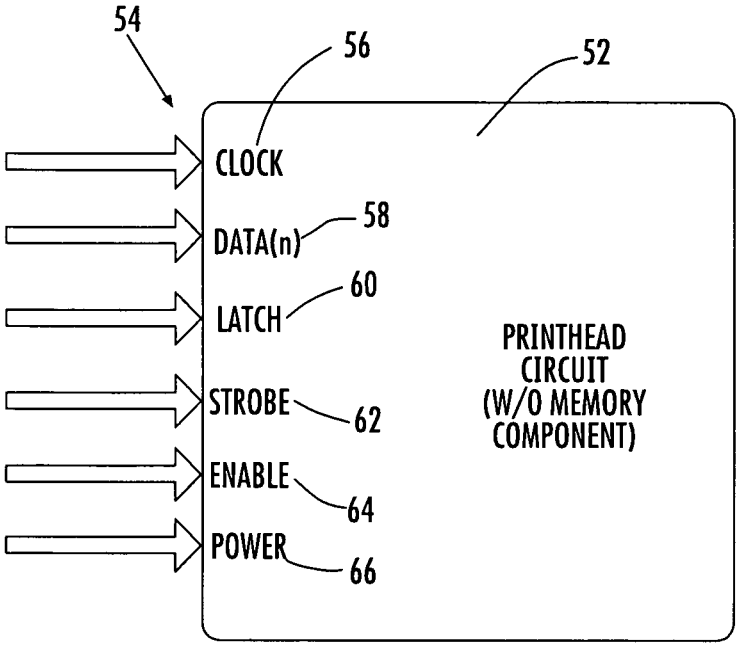
FIG. 2 (PRIOR ART)
FIG. 2 is an isolated schematic view showing prior art connections of a print head circuit.

FIG. 2 shows a schematic view of the conventional print head circuit 52 that receives a variety of electronic signals through connections 54. The connections 54 shown in the figure include a clock connection 56 for receiving a clock signal, a data connection 58 for receiving a data signal, a latch connection 60 for receiving a latch signal, a strobe connection 62 for receiving a strobe signal, an enable connection 64 for receiving an enable signal, and a power connection 66 for receiving a power signal.

Turning now to embodiments of the present invention, FIGS. 3-8 illustrate an apparatus, system and method that include a removable print head having a memory component that uses the connection or connections normally only used by the print head for receiving print data, to also transmit information bi-directionally between the printer and the print head. This can be advantageous for reducing the amount of connections needed for the printer, or in retrofitting existing printers with print heads having an associated memory component. Also, use of the additional memory component facilitates a fast upgrade of printer function with a separate upgrade of printer electronics. In addition, the memory component associated with the print head can help, through the use of more detailed parameters, improve the print quality in printers, such as thermal transfer printers which have complex printing requirements.

The present specification describes embodiments of the present invention that include a label printer that receives a removable thermal transfer print head having a secure memory component. However, although the present invention is effective for improving print quality in thermal transfer printing through the use of information available on the print head memory component, the present invention may also be employed in other types of printers. For example, the present invention could also be used for direct thermal printers or inkjet printers.

It should also be noted that for purposes of the current specification and appended claims, the term "connection" is defined as that which permits the transmission of electronic signals, and thus the term may include physical connections such as soldered connections, plug-type connections, etc., and may also include other types connections such as wireless connections including radio frequency identification technology, optical, Bluetooth®, etc. The print data transmitted through these signals allows the printer to control and/or provide power to the print head.

For purposes of the current specification and appended claims, the term "print data" represents any command, data, data stream, and/or other signal that allows the printer to control, communicate with and/or provide power to the print head.

Figure 3:
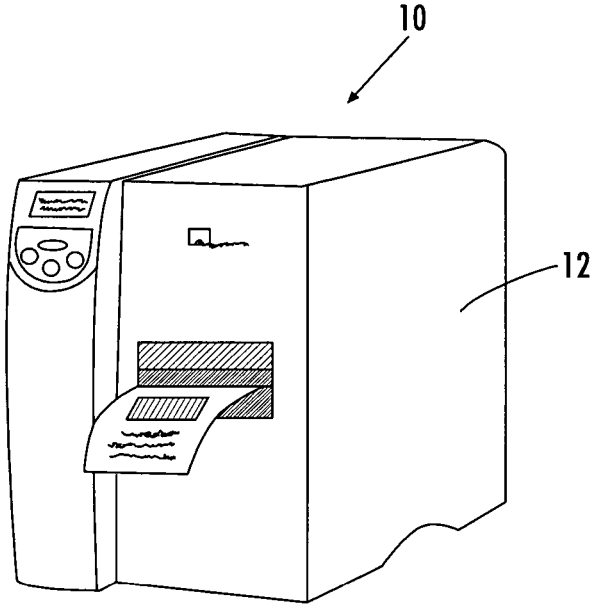
FIG. 3 is a perspective view of a printer system for printing on printable media in accordance with one embodiment of the present invention.
Figure 4:
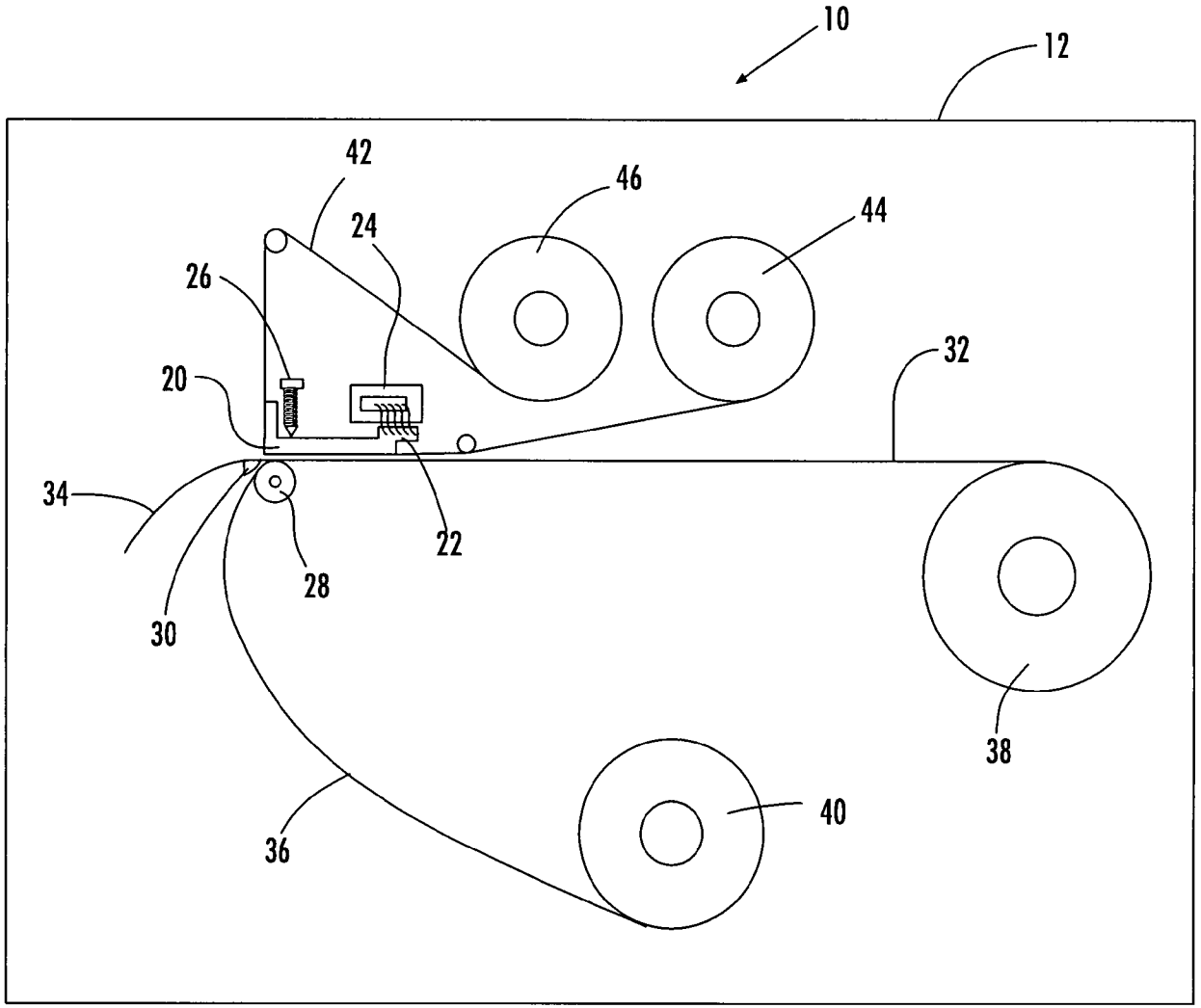
FIG. 4 is a side schematic view of a printer system having a print head in accordance with one embodiment of the present invention.

FIGS. 3 and 4 show a perspective view and a side schematic view, respectively, of a printer system 10 of one embodiment of the present invention that includes a printer 12 having a print head 20 for printing on printable media 32 to produce media units 34. In the depicted embodiment, the printer 12 is a thermal transfer printer, and the media units 34 are barcode labels. The printer system 10 of the depicted embodiment includes a print head 20 that is disposed above and biased against a platen roller 28. As noted above, the printer system of the depicted embodiment is a thermal transfer printer, and therefore a transfer ribbon 42 is provided. The transfer ribbon 42 follows a ribbon path that originates at a transfer ribbon supply 44, located upstream from the print head 20 and platen roller 28 interface. The ribbon path passes underneath the print head 20 such that the transfer ribbon 42 is disposed between the print head 20 and the platen roller 28. Spent ribbon is collected at a transfer ribbon take-up 46.

The printer system 10 of the depicted embodiment produces peelable barcode labels. Therefore, the printable media 32 of the depicted embodiment comprises peelable label units that are carried by a backing liner 36. The printable media 32 follows a printable media path that originates at a printable media supply 38 located upstream from the print head 20 and platen roller 28 interface. At the print head 20 and platen roller 28 interface, the printable media 32 passes underneath the print head 20 and the transfer ribbon 42 and above the platen roller 28. A peel bar 30 for separating a media unit 34 from the backing liner 36 is disposed proximate and downstream from the print head 20 and platen roller 28 interface. The backing liner 36 is collected at a liner take-up 40. A print head bias assembly 26 provides sufficient pressure between the print head 20 and the platen roller 28 to effect thermal printing onto the printable media 32. Electronic signals are received by the print head 20 via an electrical connection between the print head 20 and the printer 12. For example, the print head 20 of the depicted embodiment includes a plug-type print head connector 22 that electrically connects the print head 20 with a similar plug-type printer connector 24 of the printer 12.

It should be noted that, for the purposes of the current specification and appended claims, the terms "electronic," "electric," "electrically," and/or all other forms thereof, are meant to be defined as relating to technology having electrical, digital, magnetic, wireless, optical, electromagnetic, or other similar capabilities.

Thus, it should be noted that although the connection between the print head 20 and the printer 12 is shown as a physical plug-type connection, different types of male or female pluggable interfaces or other types of direct and indirect connections could be employed for electronic communication between the print head 20 and the printer 12, including physical interfaces, such as conventional and specialized interfaces including serial, parallel, digital, analog, USB, Firewire®, RS-232 connections, etc. Additionally, wireless communications may be employed, including radio frequency identification technology, optical, Bluetooth®, etc.

Figure 5:
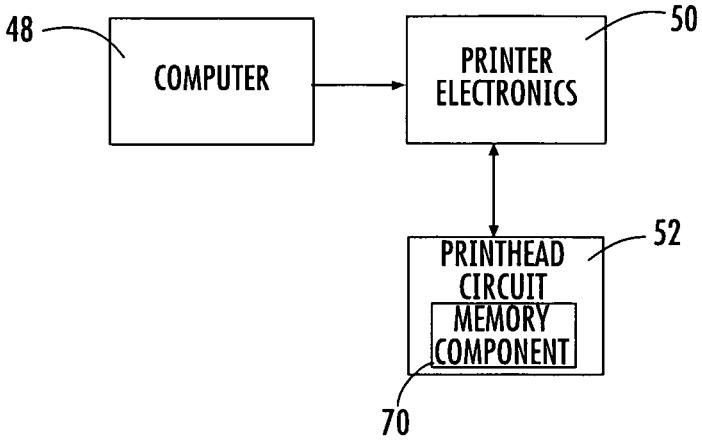
FIG. 5 is a block diagram showing communications between a computer, printer electronics, and a print head circuit in accordance with one embodiment of the present invention.
Figure 6:
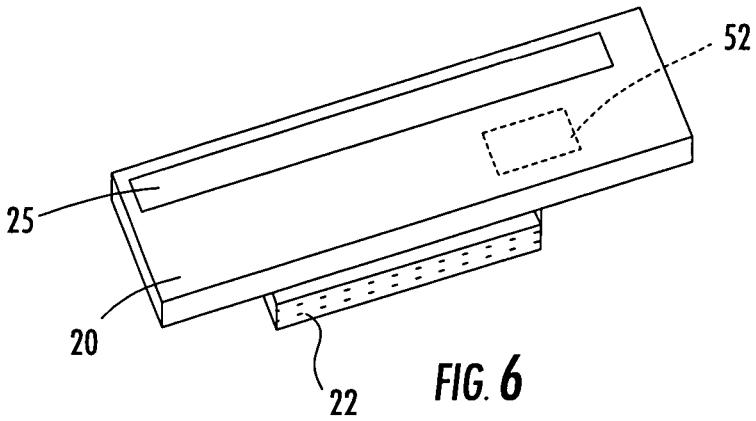
FIG. 6 is a perspective view of a print head in accordance with one embodiment of the present invention.
Figure 7:
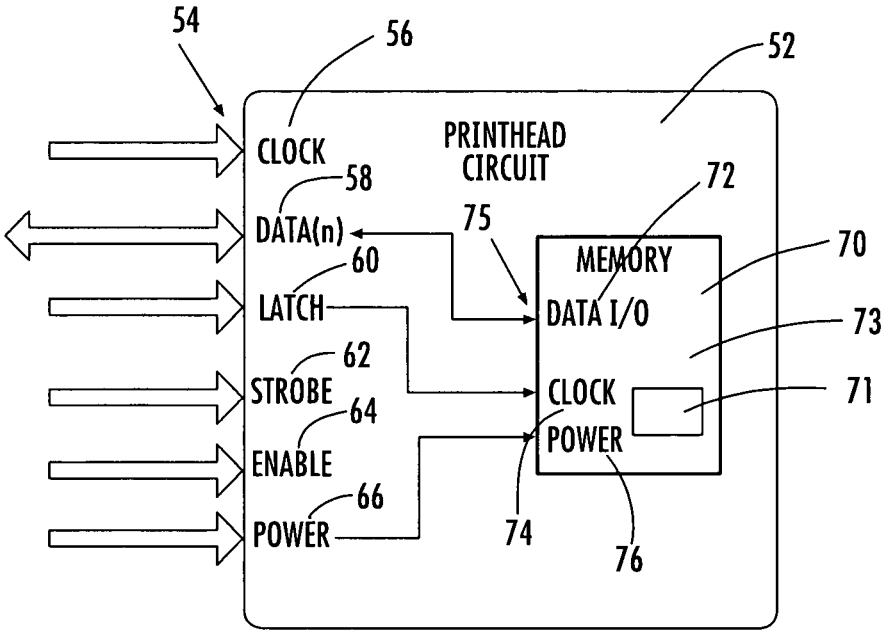
FIG. 7 is an isolated schematic view showing connections of a print head having a memory component in accordance with one embodiment of the present invention.

As shown in FIGS. 5-7, the printer 10 of one embodiment of the present invention can include a computer 48, printer electronics 50 and a print head circuit 52. In addition, as shown in FIG. 5, the print head circuit 52 includes a memory component 70 associated therewith. The memory component 70, for example, may be plugged into a connection on the print head circuit 52, wired to the circuit or even directly soldered or otherwise attached to the circuit so as to be able to communicate bi-directionally with the printer electronics 50 and the computer 48.

Figure 6A:
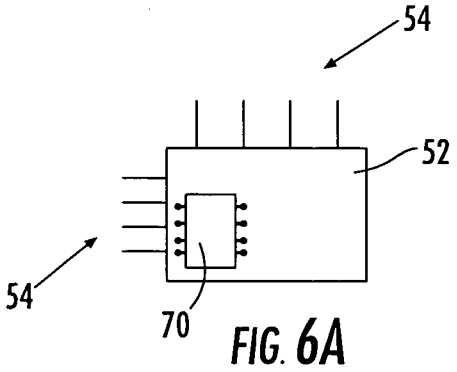
FIG. 6A is a top view of a circuit having a memory component in accordance with one embodiment of the present invention.

As shown in one embodiment in FIGS. 6 and 6A, for example, the memory component 70 is directly soldered or attached to, and supported, by a print head circuit 52. In particular, as shown in FIG. 6, the thermal print head 20 includes a print head element array 25, a print head connector 22, and a print head circuit 52. As shown in FIG. 6A, the print head circuit 52 includes the connections 54 and the memory component 70.

The print head circuit 52 of the depicted embodiment is a flexible circuit board, however in various embodiments, the print head circuit 52 may be any type of circuit, including but not limited to a printed circuit board.

In the illustrated embodiment, the memory component 70 is a CryptoMemorye® memory module available from Atmel® Corporation and includes the family of memory modules listed under model numbers AT88SC0104C to AT88SC25616C. It should be noted however, that in other embodiments, various other memory components 70 may be used for storing, sending, and/or receiving information, including secure and non-secure memory modules.

As noted above, the memory component 70 of the depicted embodiment is shown soldered directly to the circuit 52 of the print head 20. However, in other embodiments, the memory component 70 may be otherwise associated with the print head 20 through direct or indirect attachment to the circuit 52 and/or the print head 20, including but not limited to mounting the memory component 70 in a socket, or wire bonding the memory component to the circuit 52 and/or the print head 20, so as to establish bi-directional communication via the print head connector 22, or other connection, connecting the print head 20 and circuit 52 with the remaining components of the printer 10, such as the printer electronics 50 or the computer 48.

FIG. 7 shows a schematic view of the print head circuit 52 in accordance with one embodiment of the present invention. The print head circuit 52 receives a variety of electronic signals through connections 54. The connections 54 of the depicted embodiment include a clock connection 56 for receiving a clock signal, a data connection 58 for receiving a data signal, a latch connection 60 for receiving a latch signal, a strobe connection 62 for receiving a strobe signal, an enable connection 64 for receiving an enable signal, and a power connection 66 for receiving a power signal. In the depicted embodiment, the print head circuit 52 also includes a memory component 70.

As similarly described with respect to FIGS. 6 and 6A above, the memory component 70 is a secure memory module, and thus the memory component 70 includes a secure memory portion 71 and a non-secure memory portion 73. The memory component 70 of the depicted embodiment includes various inputs 75. The inputs 75 are connections that allow electrical communication with the memory component 70, including communication with the secure portion 71 of the memory component 70 as well as the non-secure portion 73 of the memory component 70. In the depicted embodiment, the inputs 75 include at least a data input 72, a clock input 74, and a power input 76.

In various embodiments of the present invention, a variety of "information" may be stored by the memory module 70 in either or both of the secure portion 71 of the memory component 70 and the non-secure portion 73 of the memory component 70. It should be noted that for the purpose of the current specification and appended claims, "information" may take the form of any single electronic data bit, or any combination of electronic data bits of a form as is known in the art to be of the type typically stored on such a memory component. The content of the information may include various information such as printer information and/or print head information.

For example, printer information may include the number of media units that have been processed by a particular printer at a particular time, or during a particular period of time. Printer information may also include manufacturing information pertaining to the printer, such as the current version of firmware loaded on the printer, an identifier that identifies the printer manufacturer, and the serial number of a particular printer.

Print head information may include, for example, identifying information that identifies a particular print head, such as print head manufacturer information, identification numbers, production run dates, serial numbers, and the like. Print head information may also include performance information, such as operating printer parameter adjustments that have been empirically determined and that have been associated with a particular print head or group of print heads in order to produce optimum print quality.

In current practice, information used to control the operating conditions of a printer, such as the operating parameters discussed above, is typically coded into the firmware architecture of the media printer. Updating the information often requires releasing a new version of firmware that must be uploaded into the printer. Thus, once a particular printer model has been released into the market, it is difficult to later introduce a new and improved print head (or, for that matter, a specialized or customized print head) without first providing a new (or specialized) version of the firmware. This limits the flexibility of a printer and a print head. Additionally, different printing applications may involve different operating parameters designed to optimize the printing conditions for each particular application. As above, in current practice, a parameter of this type is coded into the printer's firmware architecture, thus, further limiting the flexibility of a printer and a print head.

However, with respect to the present invention and in various embodiments thereof, print head information communicated to and from the printer 12 and the memory component 70 may include firmware, software, or other operating data that can be used to control a printer for specialized applications that require specialized printing parameters. For example, the secure portion 71 of the memory component 70 may include a firmware update that, because of the bi-directional communication, may be uploaded into the printer electronics 50 from the print head 20 itself, rather than requiring replacement of the printer electronics 50 or an external download of the firmware into the printer 12. In this manner, printer firmware/software updates and customization information may be provided within the print head itself, thus providing increased flexibility and ease of use advantages for the user.

In various embodiments, the information contained in the memory component 70 may be located in either or both the secure portion 71 and the non-secure portion 73. The information may be encoded in the memory component 70 of the print head 20 during manufacture or it may be written into the memory component 70 of the print head 20 before, during, or after operation of the printer.

Figure 8:
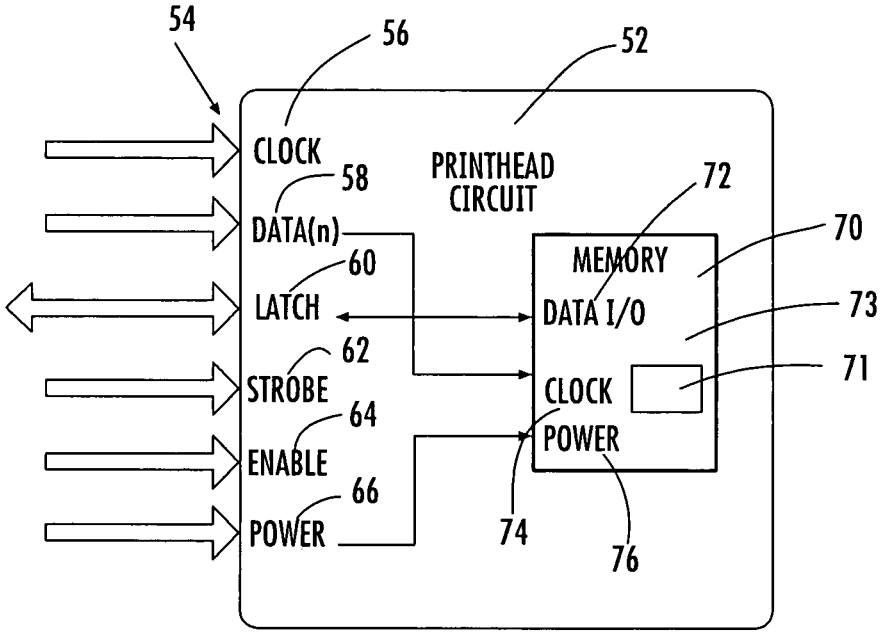
FIG. 8 is an isolated schematic view showing connections of a print head having a memory component in accordance with another embodiment of the present invention.

Two of the many possible embodiments of the present invention are depicted in FIGS. 7 and 8. Referring to FIG. 7, in one embodiment, the data input 72 of the memory component 70 is configured to electrically communicate with the data connection 58, the clock input 74 of the memory component 71 is configured to electrically communicate with the latch connection 60, and the power input 76 of the memory component is configured to electrically communicate with the power connection 66. In this embodiment, the data connection 58 is configured to communicate bi-directionally so that information contained in the memory component 70 may be communicated to the printer 12, and vice versa, via the data connection 58. In various embodiments, the data connection 58 may be configured to communicate bi-directionally in many ways, including but not limited to, modifying or replacing the printer electronics to allow bi-directional communication to and from the data connection 58.

In the depicted embodiment, the data, clock, and power inputs 72, 74, 76 are soldered to electrical leads that transmit the data, clock, and power signals 58, 60, 66 respectively. However, it should be noted that for the purposes of the current specification and appended claims, electrical communication may be produced through a variety of methods including physical plug-type connections, different types of male or female pluggable interfaces or other types of connections including physical interfaces, such as conventional and specialized interfaces including serial, parallel, digital, analog, USB, Firewire®, RS-232 connections, etc, as well as wireless connections, including radio frequency identification technology, optical, Bluetooth®, etc.

In another embodiment of the present invention, depicted in FIG. 8, the data input 72 of the memory component 70 is configured to electrically communicate with the latch connection 60, the clock input 74 of the memory component 71 is configured to electrically communicate with the data connection 58, and the power input 76 of the memory component is configured to electrically communicate with the power connection 66. In this embodiment, the latch connection 58 is configured to communicate bi-directionally so that information contained in the memory component 70 may be communicated to the printer 12 and vice versa via the latch connection 60. In the depicted embodiment, the data, clock, and power inputs 72, 74, and 76 are soldered to electrical leads that transmit the latch, data, and power signals 58, 60, and 66 respectively.

Although in various embodiments, any one input, or any combination of inputs 75 of the memory component 70 may be configured to electrically communicate with any one connection or any combination of connections 54, the embodiments depicted in FIGS. 7 and 8 are advantageous in that information is transmitted to and from the memory component 70 via the data connection 58 and latch connection 60, because of their non-simultaneous level of signal activity during printing. As a result, an existing print head circuit 52, such as that shown in FIG. 2, may be modified in accord with the present invention by associating a memory component 70 with the circuit 52, and establishing electrical communication (for an embodiment similar to that depicted in FIG. 7), between the data input 72 and the data connection 58. In the depicted embodiment, the data connection 58 is also modified to allow bi-directional communication.

Electrical communication is also established between the clock input 74 and the latch connection 60, and between the power input 76 and the power connection 66, as described above and as depicted in FIG. 7. Thus, advantageously, the embodiments depicted in FIGS. 7 and 8 allow easy and inexpensive modification of existing print heads 20 in accord with the present invention to allow bi-directional transmission of information to and from a printer and a print head by selectively choosing connections whose signal activity during printing is not simultaneous, and then using these connections to transmit information to and from the memory component 70 associated with the print head circuit 52.

As noted above, a variety of information may be stored by the memory module 70 in either or both of the secure portion 71 of the memory component 70 and the non-secure portion 73 of the memory component 70. Although any type of information may be considered secure and/or non-secure print head information as best suits the needs of the printer manufacturer, the print head manufacturer, and/or the user, in the depicted embodiment, non-secure print head information includes, but is not limited to, that information that relates to the print head manufacturing information, such what is reflected by the print head manufacturers data sheet. Also, in the depicted embodiment, secure print head data includes, but is not limited to, specific optimization and/or customization information such as optimization data and/or customized firmware.

With regard to the embodiments of the invention depicted in FIGS. 7 and 8, the non-secure portion 73 of the memory component includes at least one the following print head information: memory layout version number, manufacturer identification, manufacturer serial number, manufacturer date code, heater surface coating type, print head size, print resolution (in dots per inch), section count, print element resistance value, print element resistance tolerance, rank resistor value, printer type, printer serial number, a special code sequence indicating the content of the secure memory, cyclic redundancy check data, and a duplicate data block. In various other embodiments, secure print head information may be contained in the secure portion 71 of the memory component 70, such as, for example, tables that indicate the level of heating for the print head element array (so-called "burn tables"), field-programmable gate array ("FPGA") loads, and executable product firmware that can be used to provide printer optimization and/or customization via a print head, rather than requiring external firmware uploads into the printer. As such, this non-secure and secure print head information may be used by the printer for various reasons, including print head authentication, as well as to provide customization and specialization enhancements that may improve print quality for a user, especially in specialized applications.

As stated above, the memory component 70 may also receive and/or store information such as printer information from the printer 12. This information may be received and/or stored in either or both the secure portion 71 of the memory component and the non-secure portion 73 of the memory component 70. Thus, for example, in one embodiment of the present invention, communications with the memory component 70 are performed according to the flowchart depicted in FIG. 9.

Figure 9:
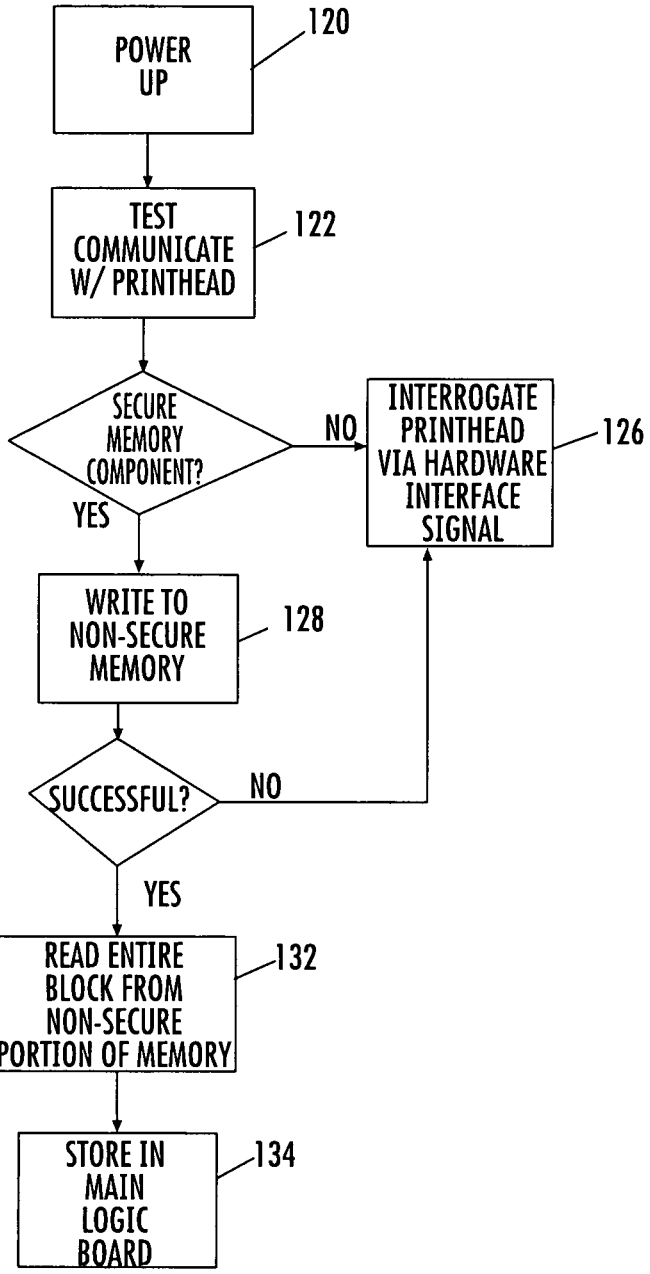
FIG. 9 is a flowchart showing computer program instructions in accordance with one embodiment of the present invention.

It should be noted that although FIG. 9 is referred to as a flowchart, the term flowchart will be understood to also include a block diagram, flowchart and/or control flow illustration. It will also be understood that each step of the flowchart can be implemented by computer program instructions. These computer program instructions may be loaded onto a computer or other programmable apparatus to produce a machine, such that the instructions which execute on the computer or other programmable apparatus create means for implementing the functions specified in the flowchart step(s).

These computer program instructions may also be stored in a computer-readable memory that can direct a computer or other programmable apparatus to function in a particular manner, such that the instructions stored in the computer-readable memory produce an article of manufacture including instruction means which implement the function specified in the flowchart step(s). The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the flowchart.

Accordingly, steps of the flowchart support combinations of means for performing the specified functions, combinations of steps for performing the specified functions and program instruction means for performing the specified functions. It will also be understood that each step of the flowchart, and combinations of steps in the flowchart can be implemented by special purpose hardware-based computer systems which perform the specified functions or steps, or combinations of special purpose hardware and computer instructions.

Referring again to FIG. 9, during operation of a printer that receives a removable print head of the present invention, an initializing test in accordance with one embodiment of the present invention may be performed at power-up, as shown by block 120. Test communications with the print head are performed (block 122) after power-up to determine if a memory component is present and whether the memory component has secure and/or unsecure components.

For example, when determining the presence of the memory component, information may be communicated between the printer and either or both of the secure portion and the non-secure portion of the memory component of the print head and a response thereto, or result thereof, compared to an expected response. The secure portion of the memory component can, for example, be accessed by sending an appropriate data key, access register, key register, and/or other key or code predetermined to gain access to the secure portion of the memory component. As such, various information may be read out of or written into either or both the secure portion and the non-secure portion of the memory component.

Returning to the embodiment depicted in FIG. 9, if a memory component including a secure memory component is present, the printer firmware attempts to write printer information (block 128), such as, for example, the printer type and the printer serial number (if not already present), into the non-secure memory component. This may include reading information from the secure portion of the memory component and writing the same information to the non-secure portion of the memory component. It may also include writing information from the main logic board of the printer electronics 50 into either or both the secure portion and the non-secure portion of the memory component.

If a memory component is not present, the printer firmware (block 126) defaults to interrogation of the print head via interface signals. This is an attempt to determine electrical characteristics of the print head and which set of configuration parameters, e.g., burn tables, should be used to operate the print head.

If the writing of printer information is successful, the memory component is read at block 132. As noted above, the memory component may have residing thereon various print head information, such as the exemplary print head information described above. The entire block of information from the non-secure memory component is preferably read (block 134) into a memory device located on the printer's main logic board, thereby equipping the printer for improved operation.

If writing of printer information at block 128 is unsuccessful, the flow turns to block 126 for determination of the print head characteristics by interrogation via a hardware interface signal. Alternatively, one or more retries of block 134 may also be attempted.

It should be noted that in various embodiments, all data transfers may be protected by CRC integrity checks. The initializing test of FIG. 9 will transmit information between the printer and the print head in order to provide flexibility and customization for producing improved printing conditions for the printer.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A print head for use with a printer, said print head comprising:

a print head circuit comprising:

a plurality of connections, the connections comprising:

a clock connection for receiving a clock signal from the printer;

a unidirectional data connection for receiving a data signal comprising print data from the printer;

a latch connection for receiving a latch signal from the printer; and at least one memory component comprising:

a data input disposed in communication with said latch connection;

wherein the print head circuit is configured to: (A) receive the latch signal from the printer to the print head circuit via said latch connection when the printer is printing, and (B) allow communication of information bi-directionally between said memory component data input and the printer via said latch connection, wherein the information comprises at least one of use data or operational data.

2. The print head of claim 1, wherein the data connection is distinct from the data input, and wherein the data input does not receive print data.

3. The print head of claim 1, the print head circuit further comprising a power connection for receiving a power signal and the memory component further comprising a power input, wherein said power input of said memory component is configured to electrically communicate via the power connection of the print head circuit.

4. The print head of claim 1, wherein the print head is removable from the printer and the memory component includes a secure memory portion configured to provide access to print head information.

5. The print head of claim 1, wherein said latch connection receives unidirectional communication of said latch signal from said printer when the printer is printing and receives bi-directional communication of information between the printer and said memory component when the printer is not printing.

6. The print head of claim 1, wherein said at least one memory component includes at least one of a secure memory portion and a non-secure memory portion.

7. The print head of claim 6, wherein said information includes at least one of a memory layout version number, a manufacturer identification, a manufacturer serial number, a manufacturer data code, a print head surface coating type, a print head size, a print head resolution, a section count, a print element resistance value, a print element resistance tolerance, a rank resistor value, a printer type, a printer serial number, a special code sequence indicating the content of the secure portion, cyclic redundancy check data, or a duplicate data block.

8. The print head of claim 7, wherein said non-secure memory portion of said memory component contains selected ones of the information.

9. The print head of claim 7, wherein said secure memory portion of said memory component contains selected ones of the information.

10. A printer system for printing indicia on printable media, said printer system comprising:

a printer having at least one communications connection;

a print head associated with the printer, the print head comprising:

a print head circuit comprising a clock connection for receiving a clock signal from the printer, a unidirectional data connection for receiving a data signal comprising print data from the printer, and a latch connection for receiving a latch signal from the printer; and at least one memory component comprising a data input disposed in communication with said latch connection, wherein the print head circuit is configured to: (A) receive the latch signal from the printer to the print head circuit via said latch connection when the printer is printing, and (B) allow communication of information bi-directionally between said memory component data input and the printer via the latch connection, wherein the information comprises at least one of use data or operational data.

11. The printer system of claim 10, wherein said latch connection receives unidirectional communication of the latch signal from the printer when the printer is printing and receives bi-directional communication of information between the printer and the memory component when the printer is not printing.

12. The printer system of claim 10, wherein the print head is removable from the printer and the memory component includes a secure memory portion configured to provide access to print head information.

13. The printer system of claim 10, wherein said latch connection receives unidirectional communication of said latch signal from said printer when the printer is printing and receives bi-directional communication of information between the printer and said memory component when the printer is not printing.

14. The printer system of claim 10, wherein said at least one memory component includes at least one of a secure memory portion and a non-secure memory portion.

15. The printer system of claim 14, wherein said information includes at least one of a memory layout version number, a manufacturer identification, a manufacturer serial number, a manufacturer data code, a print head surface coating type, a print head size, a print head resolution, a section count, a print element resistance value, a print element resistance tolerance, a rank resistor value, a printer type, a printer serial number, a special code sequence indicating the content of the secure portion, cyclic redundancy check data, or a duplicate data block.

16. The printer system of claim 15, wherein said non-secure memory portion of said memory component contains selected ones of the information.

17. The printer system of claim 15, wherein said secure memory portion of said memory component contains selected ones of the information.

18. A method for communicating information between a printer and a print head comprising a print head circuit, said method comprising:

receiving at the print head circuit a data signal comprising print data via a unidirectional data connection, a clock signal from the printer via a clock connection, and a latch signal from the printer via a latch connection when the printer is printing;

providing a memory component attached to the print head, the memory component comprising a data input disposed in communication with said latch connection; and communicating information bi-directionally between the printer and the data input of the memory component via said latch connection, wherein the information comprises at least one of use data or operational data.

19. The method for communicating information between a printer and a print head comprising a print head circuit of claim 18, wherein receiving a latch signal from the printer via the latch connection comprises receiving unidirectional communication of the latch signal from the printer.

20. The method of claim 18, including connecting the input of the memory component to the latch connection prior to bi-directionally communicating.

21. The method of claim 20, wherein connecting the input includes inserting the print head into the printer.

22. The method of claim 18, wherein bi-directionally communicating and receiving a latch signal are not simultaneous.

23. The method of claim 18, further comprising receiving a data key and wherein bi-directionally communicating is conditioned upon receiving the data key.

24. The method of claim 23, wherein bi-directionally communicating includes communicating at least one of a memory layout version number, a manufacturer identification, a manufacturer serial number, a manufacturer data code, a print head surface coating type, a print head size, a print head resolution, a section count, a print element resistance value, a print element resistance tolerance, a rank resistor value, a printer type, a printer serial number, a special code sequence indicating the content of the secure portion, cyclic redundancy check data, or a duplicate data block.

25. A print head for use with a printer, comprising:

a print head for receiving data or commands from a printer and controlling said print head for printing, said print head circuit comprising:

a plurality of connections, the connections comprising:

a clock connection for receiving a clock signal;

a unidirectional data connection for receiving a data signal comprising print data from the printer;

a latch connection for receiving a latch signal from the printer; and at least one memory component comprising:

a data input disposed in communication with said latch connection; wherein the print head circuit is configured to: (A) receive the latch signal from the printer to the print head circuit via said latch connection when the printer is printing, and (B) allow communication of information bi-directionally between said memory component data input and the printer via said latch connection, wherein the information comprises at least one of use data or operational data.

26. The print head of claim 25, wherein said latch connection receives unidirectional communication of the latch signal from the printer when the printer is printing and receives bi-directional communication of information between the printer and the memory component when the printer is not printing.

27. The print head of claim 25, wherein the at least one memory component is configured to selectively allow communication of the information via said data input when the latch connection is not receiving a latch signal.

28. The print head of claim 25, wherein the memory component includes a secure portion accessible using a data key.

29. The print head of claim 28, wherein print head information is stored on the secure portion of the memory component.

30. A method for communicating information between a printer and a print head comprising a print head circuit and a memory, said method comprising:

in response to the printer performing a print job:

receiving a clock signal from the printer at a clock connection of the print head circuit;

receiving a data signal from the printer at a data connection of the print head circuit;

receiving a latch signal from the printer at a latch connection of the print head circuit;

in response to the printer not performing a print job:

communicating bi-directionally between a data input of the memory and the printer via the latch connection.

31. The method of claim 30, wherein the clock connection, data connection, and latch connection are each configured to be uni-directional in response to the printer performing a print job, and wherein the latch connection is configured to be bi-directional in response to the printer not performing a print job.

* * * * *